US005726538A

United States Patent [19]

Jackson et al.

[11] Patent Number: 5,726,538

[45] Date of Patent: Mar. 10, 1998

[54] CATHODE RAY TUBE DISPLAY WITH CANCELLATION OF ELECTRIC FIELD EMISSIONS

[75] Inventors: Frederick S. Jackson, Glasgow, Scotland; David Leaver, Hassocks, United Kingdom; Andrew Ramsey Knox, Kilbirnie; John S. Beeteson, Skelmorlie, both of Scotland

[73] Assignee: International Business Machines Corporation, Armonk, N.Y.

[21] Appl. No.: 257,850

[22] Filed: Jun. 10, 1994

[51] Int. Cl.[6] ..... H01Q 1/00

[52] U.S. Cl. ..... 315/370; 315/8

[58] Field of Search ..... 315/370, 8, 85; 361/150

[56] References Cited

U.S. PATENT DOCUMENTS 5,151,635 9/1992 Cappels ..... 315/370

5,243,262 9/1993 Moen ..... 315/370

5,396,151 3/1995 Cappels, Sr. ..... 315/8

*Primary Examiner*—Theodore M. Blum

*Attorney, Agent, or Firm*—Douglas W. Cameron

[57] ABSTRACT

A cathode ray tube display having reduced electric field emissions comprising a cathode ray tube 100, an element 200 for detecting modulations in the final anode voltage of the CRT, the signal not being directly dependent on the deflection driving means 115. A matching network 205 provides phase and gain correction to the signal from element 200, amplification means 210 receives the signal from network 205 and an emission means 215 radiates a cancelling electric field dependent on the modulations detected by said element 200.

10 Claims, 3 Drawing Sheets

CATHODE RAY TUBE DISPLAY WITH CANCELLATION OF ELECTRIC FIELD EMISSIONS

DESCRIPTION

1. Technical Field

The present invention relates to apparatus and methods for reducing electric field emissions of a cathode ray tube (CRT) display by the addition of cancellation fields.

2. Description of the Prior Art

A conventional raster scanned CRT display such as a television receiver or a computer visual display unit comprises circuitry that can generate electric fields of sufficient strength to radiate beyond the display. Various studies have raised public concern about these electric fields and the possible health hazards associated with them. As a result of these concerns various standards have been introduced defining maximum emission levels which products claiming to meet these standards can emit. In Northern Europe, products can be tested to a standard developed and administered by TCO, the Swedish Confederation of Professional Employees. To meet this standard, true rms values of emissions in the frequency band from 2 kHz to 400 kHz are measured and must be less than 1 volt/meter.

A CRT display typically comprises horizontal and vertical electromagnetic deflection coils arranged on a yoke mounted around the neck of the CRT. In operation, currents having a sawtooth shaped waveform flow through the deflection coils to scan the electron beam or beams across the CRT screen in a raster pattern. The voltages across the deflection coils reach a peak during the retrace or flyback period of the sawtooth currents. The peak voltage signals have a large component of harmonics of the corresponding deflection frequencies.

The electron beam or beams are accelerated from the neck of the CRT to the screen by a "final anode" or Extra High Tension (EHT) voltage of typically 25 kV for a color display. The flow of electrons is referred to as "beam current". The EHT voltage is typically generated from a step up transformer synchronized to the line scan. In displays having integrated EHT generation and horizontal deflection circuits, the voltage pulse signal driving the primary of the transformer is derived from the peak voltage across the horizontal deflection coil. In displays having separate EHT generation and horizontal deflection circuits, the voltage pulse signal is generated separately from the line scan signal, but may be synchronized with it, although not necessarily in phase.

The output impedance of the EHT generator is sufficiently high that changes in beam current loading through screen content cause modulation of the EHT voltage. This is the primary source of radiated electric fields in front of the display. This modulation of the internal CRT final anode voltage is coupled through the CRT faceplate and transmitted through an intervening medium (air in this case) to the observation point.

Electric field emissions from CRT displays can be reduced by enclosing the radiating conductors with grounded metal screens. However, such screens can be expensive to manufacture and can complicate assembly of the displays. In addition, the screening necessary to reduce emissions from the front of a display is usually in the form of a custom manufactured conductive optical panel which is transparent to the light emitted from the CRT phosphor. The screen image is viewed through the panel which can affect image quality. In addition these panels are expensive to manufacture.

U.S. Pat. No. 5,151,635 describes an apparatus and method of reducing these time varying electric fields by providing a cancellation field of equal magnitude but opposite polarity to those generated by the display. Separate sensors for the field generated by the horizontal deflection circuit, degaussing circuit and other circuits are provided and radiating antennae provided for each of these cancellation fields.

European Patent Application 0 523 741 describes a similar apparatus which senses the electric field associated with the deflection yoke and provides a signal to a radiating antenna.

For displays having integrated EHT generation and horizontal deflection circuits, the electric field sensed from the deflection circuit is similar to the actual electric field emitted from the display and so some cancellation of the primary source of radiated electric fields in front of the display is achieved. However for displays having separate EHT generation and horizontal deflection circuits, such a system may not achieve cancellation of the field, since although the two circuits are usually, but not always synchronized, they may be distinct in phase.

Prior art methods of using cancellation fields to reduce electric field emissions have used either combined EHT generation and horizontal deflection circuits or separate circuits, but with the circuits in phase as well as synchronized. For these monitors the use of a signal from the horizontal deflection circuit to control the cancellation field provided some reduction in field emissions, but the fact that the primary source of radiated electric fields from the front of the display was the modulation of the internal CRT final anode voltage was not apparent due to the in phase synchronous nature of the two circuits.

It is advantageous to sense this modulation directly and to provide cancellation based on this modulation rather than based on the horizontal deflection circuit. Even though the prior art method of sensing the field generated by the horizontal deflection in an integrated EHT generation and horizontal deflection circuit will provide some cancellation, improved cancellation can be achieved by sensing the modulation of the CRT final anode voltage directly. It is desirable to achieve emission levels of under 1 V/m in order to meet the TCO standard. It is unlikely that such levels can be achieved without eliminating modulations of the CRT final anode voltage.

SUMMARY OF THE INVENTION

Accordingly the invention provides a cathode ray tube display having reduced electric field emissions comprising a cathode ray tube provided with a final anode voltage, a deflection means and means to drive said deflection means, an element adapted to detect modulations in said final anode voltage and to provide a signal representing said modulations, said signal not being directly dependent on the deflection driving means, a matching network providing phase and gain correction to the signal from element, said correction being dependent on the frequency of the signal, amplification means receiving the signal from network and providing a signal of opposite polarity to that representing said modulations, and an emission means for radiating a cancelling electric field dependent on the modulations detected by said element.

Also provided is a method for reducing the electric field emissions from a CRT display, the CRT being provided with a final anode voltage, the method comprising the steps of detecting the magnitude and phase of modulations in the final anode voltage and providing a signal representing said modulations, said signal not being directly dependent on the deflection driving means 115, providing phase and gain correction to the provided signal, said correction being dependent on the frequency of the signal, amplifying the phase and gain corrected signal such that a signal of opposite polarity to that representing said modulations is produced, and radiating the produced signal so as to create a cancelling electric field such that the field emissions from the CRT display are reduced.

BRIEF DESCRIPTION OF THE DRAWINGS

Embodiments of the invention will now be described, by way of example, with reference to the accompanying drawings, in which.

DETAILED DESCRIPTION OF THE INVENTION

Figure 1:
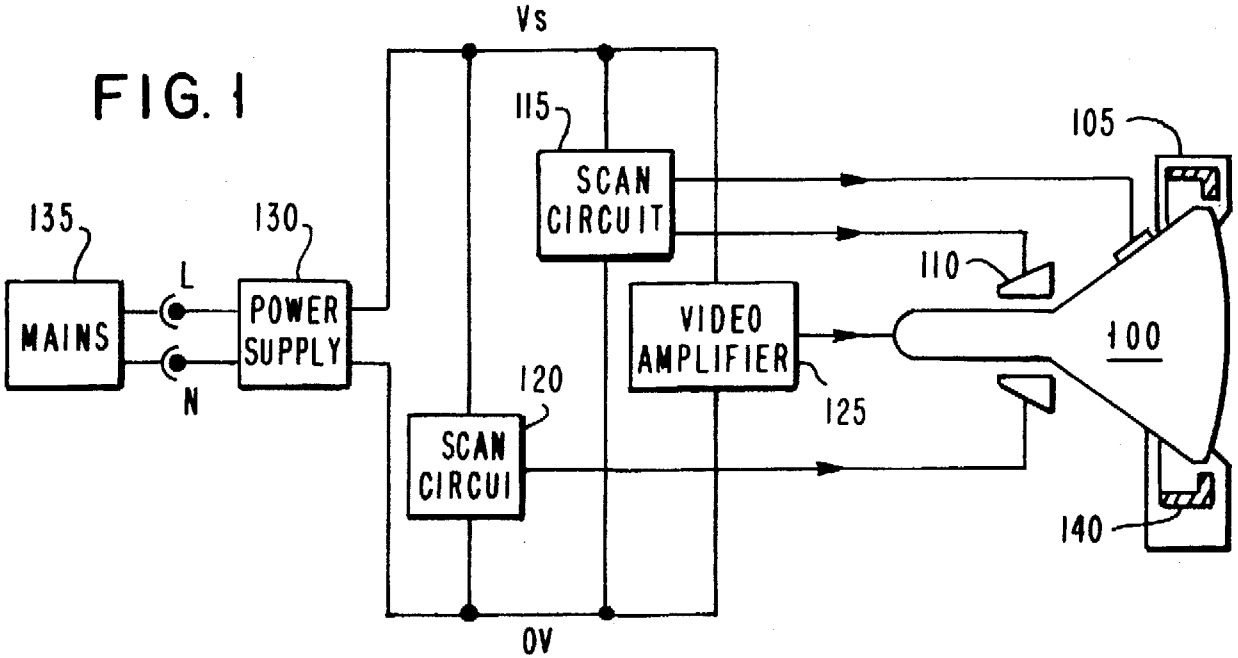
FIG. 1 is a block diagram of a CRT display.

FIG. 1 shows a color CRT display comprising a CRT 100 framed in, and supported by a bezel 105. Horizontal and vertical deflection coils are disposed around the neck of the CRT in a yoke 110. In use, the CRT is controlled by a drive circuit. The drive circuit comprises horizontal and vertical scan circuits 115 and 120 connected to the horizontal and vertical deflection coils respectively, a video amplifier 125 connected to the electron gun of the CRT 100, and a power supply 130 for supplying power from the mains at 135 to scan circuits 115 and 120 and video amplifier 125 via supply rails Vs and OV. Horizontal deflection circuit 115 comprises an integral EHT generator connected to the final anode of CRT 100. In an alternative embodiment, the EHT generator is separated from the horizontal deflection circuit, but operates synchronized to the horizontal scan circuit. Although the operation is synchronous to the horizontal scan circuit, it is not necessarily in the same phase. The EHT generator includes a step-up transformer, the output of which is then rectified by high voltage diodes to produce, in conjunction with the CRT capacitance, a dc output. A high resistance path to discharge the CRT capacitance (a bleed assembly) is present across the CRT. Not shown in this diagram is a degauss coil for demagnetizing the CRT shadow mask. This coil operates generally whenever power is applied to the display. Thermistors, whose resistance depends on temperature are used to cause the resultant current through the degauss coil to decay rapidly from a peak at switch on to a lower value. This lower value should have no visible effect on the screen, but nevertheless there is a residual mains frequency field emitted.

In operation, power supply 130 receives power from the mains at 135. Line and frame scan circuits 115 and 120 generate line and frame sawtooth currents in the horizontal and vertical deflection coils scan three electron beams across the CRT screen 100 in a raster pattern. Video amplifier 125 modulates the electron beam intensities with picture information in response to externally supplied red, green and blue video signals. The sawtooth scan currents are synchronized to the input picture information by externally supplied horizontal and vertical synchronization signals.

The primary source of radiated electric fields in front of the CRT display of FIG. 1 is the modulation of the internal CRT final anode voltage. This modulation is coupled through the CRT faceplate and transmitted through an intervening medium (air in this case) to the observation point. The final anode modulation is caused by imperfect voltage regulation when beam current flows. In order to cancel the field from this EHT modulation voltage, the modulation voltage must be sensed and then transmitted in antiphase by a secondary radiator to cancel the original signal.

Figure 2:
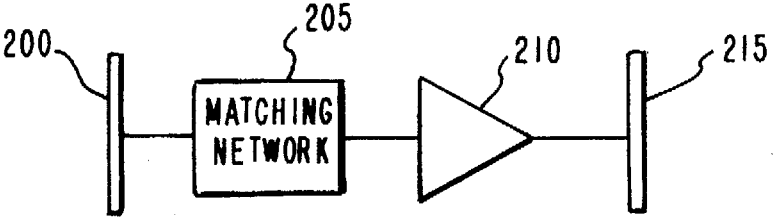
FIG. 2 is a block diagram of a first embodiment of the cancellation system of the present invention.

FIG. 2 shows the essential elements of the open loop electric field cancellation system of the present invention. Element 200 is an antenna used to detect the radiated electric field from the CRT faceplate. A matching network 205 is required to provide frequency and phase correction to the signal detected by element 200 before amplification by amplifier 210 and subsequent radiation by radiator 215.

In order to detect only the EHT modulations seen at the CRT faceplate a signal is required which uniquely identifies these modulations. There is no such signal present within the circuits described in the conventional monitor of FIG. 1. The EHT feedback loop of a separate EHT generator, for instance, which does have information in it concerning these modulations, has the DC component of the EHT voltage present for regulation purposes. Additionally on this signal is a quiescent current which passes through the step-up or flyback transformer (FBT) bleed resistor assembly. There is also considerable noise coupled into the EHT windings switching transients in the FBT. Hence it is not possible to use this signal to provide information on the beam current only which flows through the CRT assembly itself. A signal which provides information on the beam current is an accurate measurement of the EHT voltage variations.

A possible source of such a signal is through electrostatic coupling to the CRT shadow mask. A conductive plate is attached to a section of the CRT glass which is free of any other conductive material, for example, a dag coating. This conductive plate forms the second plate of a capacitor, the first of which is the CRT shadow mask. The intervening vacuum and glass form the capacitor dielectric. The shadow mask is electrically connected to the internal CRT metalization that forms the final anode and therefore any final anode voltage modulations will be observed on the second plate of this capacitor. Care must be taken to ensure that stray electromagnetic fields from other components do not induce unwanted signals in this plate. An example of such stray electromagnetic fields is the residual current flowing in the degauss coil. This effect may be excluded by either shielding the second capacitor plate or by placing the plate on a region of the CRT where fields are not intrusive. Due to the mechanical simplicity of this detection method, this is the preferred embodiment. The second plate described can advantageously be a piece of copper tape adhesively attached to the underside of the CRT near the bezel. At this point, the degauss coil and yoke trimmers (a strong source of unwanted fields) are located away from the antenna and do not induce measurable errors in the desired signal.

In an alternative embodiment an insulated conductor is placed in close proximity to the final anode lead for a distance of approximately 100 mm. The current flowing in the final anode lead induces an equivalent voltage in the adjacent conductor which is representative of the beam current and hence the EHT modulations. The sensing conductor needs a screen to prevent extraneous voltages being developed in the conductor from sources such as the CRT yoke.

Figure 3:
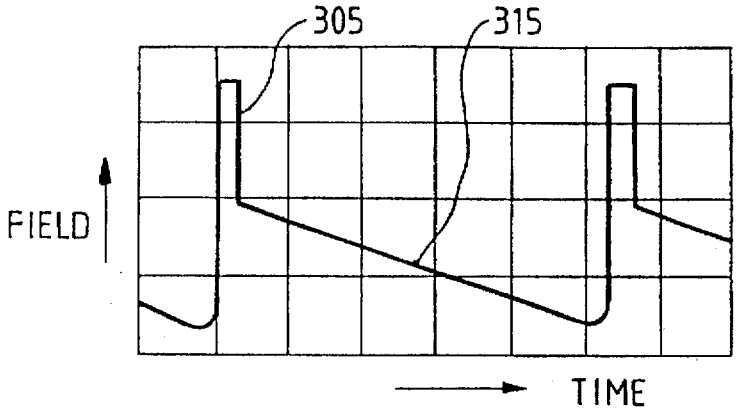
FIG. 3 is a waveform showing the charging pulse and line ramp components of the emitted electric field from the display of FIG. 1.

FIG. 3 shows the voltage induced in the conductive plate, which is an analogue of the radiated electric field from the display. The induced voltage waveform is complex but three discrete components, a charging pulse 305, line ramp modulation 315 and font modulation 410 in FIG. 4 can be identified. It is necessary to understand each of these in order to provide an effective cancellation system. These components may not be present in all regulated systems, for example, the line ramp and font modulation may not be present in a simple bulk regulator. However such a bulk regulator uses considerably more power and is of higher cost. Use of the invention allows low electric field emission with a lower power, higher performance and lower cost type of regulator.

Waveform component 305 is the charging pulse. This pulse approximates to a half sinusoidal pulse whose duration is related to the conduction period of the diodes in the EHT generation circuit. Typically this pulse will have a duration of 2 to 3 uS and have significant frequency content extending to above 1 MHz. This is the component having the highest frequency content and thus determines the upper frequency limit for amplification with fidelity. The repetition frequency of these pulses is the line frequency of the display.

Waveform component 315 is the line ramp modulation. The EHT capacitance (which comprises the inherent capacitance of the CRT and any additional external capacitance) is only recharged during the flyback part of the cycle. During this time current flows into the capacitance. Between consecutive flyback parts of the cycle current flows from the charged capacitor. One of the paths is a quiescent discharge via the bleed assembly, the magnitude of current flowing being typically of the order of 50 uA. Another of the paths is any beam current which flows within the CRT. For a scan line with no beam current flowing at any point throughout the line, no additional current will flow. For a scan line where the displayed information throughout the line is high intensity white, significant beam current will flow. Other patterns will produce currents between these extremes. The EHT voltage modulation caused by these currents is an exponential decay of the final anode voltage, the magnitude of the modulation depending on the beam current.

Figure 4:
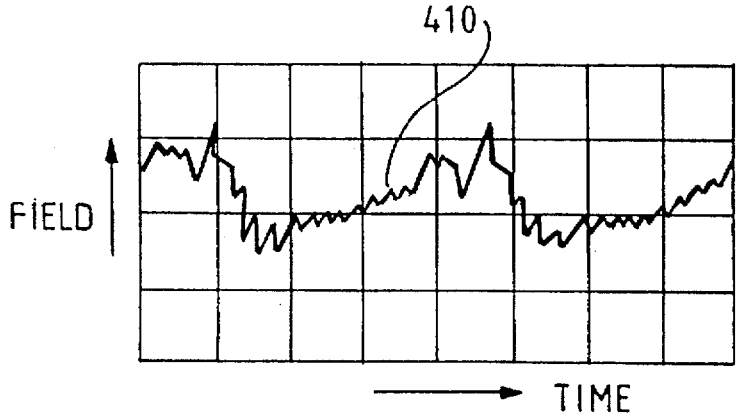
FIG. 4 is a waveform showing the font modulation component of the emitted electric field from the display of FIG. 1.

FIG. 4 shows the font modulation component 410. In a monitor that has a closed loop EHT regulation system, this system has a finite response time to transient EHT loads. This response time is of the order of 100 uS and can be seen in FIG. 5 as an undershoot for increasing loads and an overshoot when a load is decreased or removed.

Figure 5:
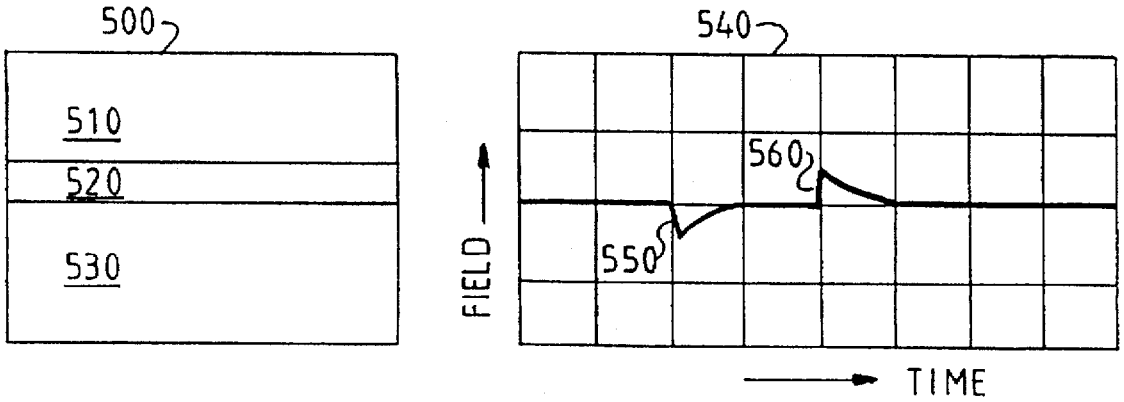
FIG. 5 is a diagram and waveform showing undershoot and overshoot of the EHT voltage of the display of FIG. 1.

FIG. 5 shows a displayed image having parts 510, 530 of the screen 500 that are substantially black, that is no data displayed. During these periods no beam current flows. In FIG. 5, the central part 520 of the screen 500 has data displayed. During this part of the scanning of the spot from the top of the screen to the bottom of the screen, beam current flows. Also shown in FIG. 5 is the variation of the electric field associated with this font modulation. At 550 is shown the undershoot when significant beam current starts to flow and at 560 the overshoot resulting from the transition to no beam current flowing can be seen. The resultant overall field waveform has the charging pulse and line ramp modulation superimposed on it. The frequency of the font modulation component is of particular significance for four reasons:

a) The font modulation frequency may be found by dividing the number of lines of text by the active frame time. For text modes this frequency is typically in the range 1.6 kHz to 2.5 kHz. It may be higher for text displayed in graphics modes when a large number of lines of text are displayed. Note that this modulation frequency is dependent on the frame rate and not the line rate. This is important when considering use of the invention in a display with variable frequency line rate operation but with a fixed response time from the EHT regulation system. Additionally the font modulation frequency varies proportionally with the number of lines of text displayed and the specific mode that such a monitor with variable frequency line rate operation is operating in, that is the number of lines used to present the font.

b) The CRT cutoff frequency for efficient propagation of the electric field to space is in the region of 2 kHz for a typical CRT, that is one having a 14 to 15 inch screen.

c) When measurements are made to the TCO91 standard the lower passband −3 dB limit of the measuring system is 2 kHz.

d) This low frequency font modulation has a significant amplitude, typically in the region of 30 V peak to peak (pp) for rows of bright text. This places particular demands on the amplifier circuit described later.

When these four effects are taken together, it will be seen that the cancellation problem suddenly becomes much more complex than may be first supposed. Specifically, the circuit must now operate correctly in a region where the transition from passband to cutoff is experienced. The measurement technique for TCO91 which has been defined by SWEDAC ,the Swedish National Board for Measurement and Testing, employs a true rms reading of the radiated field and therefore to achieve cancellation, good phase control of the antiphase signal is needed. To achieve this, it was found essential to provide a separate gain/phase correction network for the sensor.

Figure 6:
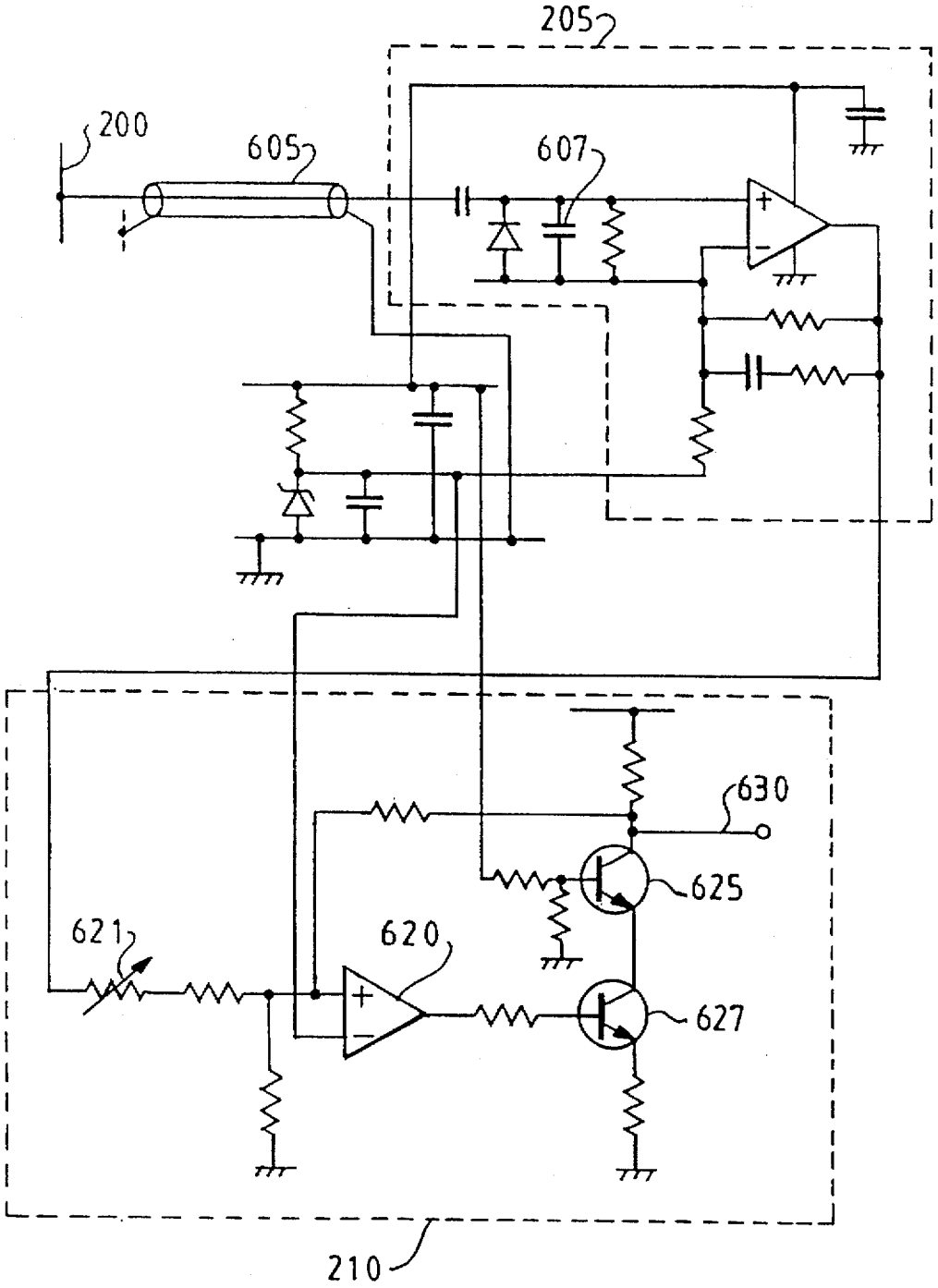
FIG. 6 is a circuit diagram of the phase correction network and amplifier of the cancellation system of FIG. 2.

The signal from the conductive plate provides a good analogue of the EHT modulation voltage. However, there is some frequency related distortion present which must be corrected in order to achieve the desired level of electric field cancellation. Additionally, as previously noted, care must be taken to ensure extraneous signals are not imposed on this signal. It has been found necessary to provide a screened connection from the antenna 200 to the amplifier 210 such as a co-axial cable 605, shown in FIG. 6. Only when a coaxial transmission line is driven and terminated in its characteristic impedance do the reactive elements of the transmission line become zero. Otherwise, the finite cable inductance and capacitance are elements significant to the signal propagation. The antenna (conductive plate) used has a very high impedance and therefore the coax can be neither driven nor terminated by the characteristic impedance. The cable presents a distributed impedance but for practical purposes due to the short length (270 mm) this may be modelled as a lumped inductance and capacitance. The phase correction network 205 provides additional low frequency gain for the sensor in the feedback network of the first amplifier. This boosts the detected font modulation in the CRT radiation frequency transition region between cutoff and passband. A simple network provides adequate correction over this region, provided that it is optimized over the whole of the line frequency operation range. Specific frequencies may be further improved at the expense of a more complex network. The radiation characteristics of different CRT sizes have to be considered and can advantageously be combined with the coax correction network. By doing this, changing one small capacitor 607 can be used to tune the circuit for optimal operation on varying CRT sizes.

As mentioned previously, effects such as charging pulses and line ramp modulations occur at frequencies between the horizontal scan frequency and approx 1 MHz. These are of relatively low amplitude, typically less than 10 Vpp on the secondary radiator and can be readily amplified by high performance Operational Amplifiers. However, the font modulation frequency whilst being low frequency (a few kHz) has a high amplitude, typically 30 Vpp for a screen of H characters displayed in positive video. The charging pulses and line ramp modulations are superimposed on this. Thus the amplifier 210 needs to have a large dynamic range and also to have a high slew rate. The dynamic range of the amplifier 210 must exceed 40 V and it must provide amplification with fidelity for signals having a frequency up to 1 MHz.

High voltage operational amplifiers are available but they have poor high frequency response. High voltage and high frequency operational amplifiers are extremely expensive, being of equivalent cost to the bonded panel solution to electric field reduction and so are not advantageously employed in the present invention. A fast op-amp 620 configured in a closed loop with a cascode stage 625, 627 in the signal path to provide high voltage output is used in a preferred embodiment. Both the cascode 625, 627 and operational amplifier 620 have the required gain split between them to retain the bandwidth without causing unwanted HF radiation. Optionally, the amplifier also has variable gain 621 to allow final optimization of the cancellation of the electric field emissions. Note that this operational amplifier/cascode combination uses the operational amplifier 620 in an inverting configuration, but with feedback applied to the non-inverting input since the cascode is an inverter and thus the sense of the cascode feedback signal is inverted. Also, peaking networks are not used so as to retain waveform fidelity.

Use of the circuit described above and in FIG. 6 has a sufficient dynamic range for most applications such as CRT displays having fourteen or fifteen inch color CRTs. However for such displays which have very high performance regulators for the EHT circuits, the levels of emission can be up to three times higher. This requires a higher cancelling circuit voltage and a larger area of radiating antenna 215. Further, when such circuits are used on larger size CRT displays, such as ones having seventeen or twenty one inch CRTs, the levels of emission are higher still because of the increased beam current needed. The ratio of bezel radiator to screen area is less for a larger screen CRT and so the efficiency of the antenna 215 is reduced. Therefore For both the higher performance regulators and the larger CRTs, a larger dynamic range of the amplifier 210 is required.

This can be achieved by increasing the supply voltage used for the amplifier 210, but this results in increased power dissipation of the amplifier. Also, when using a worst case test pattern on a large screen CRT display, a dynamic range of up to 170 volts may be required. A worst case test pattern is, for example, a white screen with a black rectangular box located in the central area of the screen, the black box being large enough that the beam current limit does not start to operate and being position so that its larger dimension is horizontal. To construct such an amplifier is not a practical solution within the various constraints present such as cost, available supply voltages and power dissipation.

An alternative solution to this problem is to add an offset to the input of the power amplifier so as to compensate for variations of the offset in the signal from the sense amplifier. In this way the dynamic range of the output amplifier can be more fully utilized. The offset in the output voltage from the sense amplifier, supplied to the circuit, is detected by peak-detecting the sense amplifier signal (with a decay rate to match the regulator natural time constant) to remove the high frequency pulses and leave the low frequency envelope. When the peak of the input signal from the sense amplifier exceeds a threshold, a correction current is generated. The threshold is set by the values of resistors. Separate peak detectors 704, 706 are used to detect the peak positive voltage and the peak negative voltage. The correction current represents the offset in the sense amplifier signal. The correction current is only present when the offset exceeds the threshold set by resistors. An amplifier provides a sink for current when the offset exceeds the positive threshold, while another amplifier provides a source for current when the offset exceeds the negative threshold. The correction current is injected into the output amplifier summing node, thus correcting the offset received by the output amplifier from the sense amplifier through resistor 621. In this way, the output amplifier is able to be driven with a larger alternating signal while not being driven into saturation. Zener diodes are added in the peak detecting circuits across the diodes to force the thresholding off when the sense signal changes direction.

The radiating antenna (conductive plate) described below may be electrically considered as a capacitive load on the cascode output 630. This capacitive load will cause loop stability problems for fast operational amplifiers. To counter this, the capacitance may be isolated from the cascode by the use of a series resistor (not shown in FIG. 6) in the drive to the secondary radiator, or a capacitive feedback added to balance the input capacitance of the amplifier. In the latter case, it is important that only the minimum capacitance needed for balancing be used (usually 2–3 pF) to avoid bandwidth reduction.

The geometry of the radiating antenna (the secondary radiator) 215 is crucial to efficient operation of the overall cancellation system. The primary CRT radiation may be considered as being transmitted from an metal plate equivalent in size to the CRT faceplate. To counter this field, the secondary radiator 215 is designed to surround the primary radiator in order that effective cancellation in space may be achieved without excessive distortion. Minimization of nodes and antinodes in the combined wavefronts propagating through space is then achieved. This is essential if the true spirit of the compliance of the TCO standard is to be adhered to. The voltage drive required to the secondary radiator depends on the available radiating surface area. To simplify the amplifier design requirements the radiator should be made as large as is practical.

In a preferred embodiment, the secondary radiators are fabricated by using conductive inserts 140 into the CRT bezel 105. Differing bezel inserts 140 are used for different sized CRTs 100. The gain adjustment 621 of the amplifier 210 described above allows optimization of the drive to the secondary radiator 215 for different sized CRT's 100.

The embodiment described above is effective and easily provides the necessary field cancellation necessary for TCO compliance. Measurement of the residual field indicates that the radiated emissions are about one quarter of those allowed by the standard. The limit is 1 V/m electric field at a distance of 300 mm and the embodiment described above can achieve 0.25 V/m under worst case conditions.

Since the detection of the primary radiated field is independent of any signals relating to the scan circuits, the circuit is not dependent on the mode, line frequency or other scan parameters other than that which actually causes a radiated field. This is of particular benefit since a consequence of this detection method is that cancellation is automatic for emissions across the entire operating frequency range of a variable line Frequency monitor. It is also independent of the screen pattern or brightness displayed.

In another embodiment of secondary radiator design the single radiator may be replaced by a pair (or more) of concentric radiators. The required cancellation signal has two main components: a large amplitude low frequency component and a small amplitude high frequency component. The high frequency radiator would ideally have small area and hence capacitance, making it easier to drive from a high frequency closed loop amplifier. Since this amplifier would only deal with the high frequency, low amplitude components, the wide dynamic range requirement is relaxed. Conversely for the low frequency radiator, high dynamic range is required but with low frequency of amplification. The separation of the frequency bands radiated by each radiator allow a more efficient implementation may be realized although at higher cost.

The use of simple plates whilst effective may not give optimal performance. In another embodiment, the use of a three dimensional antenna design allows a more directional cancellation field to be produced which would again simplify the design of the amplifier.

In a variation of the preferred embodiment an LED may be fitted to the circuit to show when it is in fact producing an antiphase cancelling signal. This overcomes the problem that failure of the cancellation circuit will have no observable effect on the monitor operation.

In the preferred embodiment of this circuit all the components are mounted on the main circuit card. However, in another embodiment, this circuitry could easily be fitted on the secondary bezel radiator to allow the system to become an "optional extra" to an existing display. In yet another embodiment, the secondary radiator could also act as the heatsink for the upper cascode transistor. No connections between the main circuit card and the secondary radiator would then be required apart from those to provide power.

Preferred embodiments of the present invention have been hereinbefore described with reference to a color CRT display. However, it will now be appreciated that the present invention is equally applicable to monochrome CRT displays.

Having thus described our invention, what we claim as new and desire to secure by Letters Patents is:

1. A cathode ray tube display having reduced electric field emissions comprising:

a cathode ray tube having a final anode voltage, a deflector and a device to drive the deflector;

an element for detecting modulations in the final anode voltage and for providing a signal representing the modulations, the signal not being directly dependent on the device to drive the deflector;

a matching network for providing phase and gain correction to the signal from the element said correction being dependent on a frequency of the signal;

an amplifier for receiving the signal from the matching network and for providing a second signal of opposite polarity to the first signal representing the modulations; and an emission device for radiating a cancelling electric field dependent on the modulations detected by the detection element.

2. A cathode ray tube display as claimed in claim 1, wherein the first signal representing said modulations is electrostatically coupled from the CRT.

3. A cathode ray tube display as claimed in claim 2, wherein the detection element is formed by a conductive plate external to the CRT.

4. A cathode ray tube display as claimed in claim 1, wherein the detection element is formed by a conductor located parallel to the lead supplying the final anode voltage.

5. A cathode ray tube display as recited in claim 1, wherein the display further comprises a regulating means providing control of the final anode voltage.

6. A cathode ray tube display as recited in claim 1, wherein said emission means is located concentrically with the CRT.

7. A cathode ray tube display as recited in claim 1, wherein said amplification means comprises a plurality of amplifiers each amplifying a specific range of frequencies, and wherein said emission means comprises a plurality of emission means each emitting a specific range of frequencies.

8. A cathode ray tube display as recited in claim 1, further comprising a visual indication means that the cancellation system is operational.

9. A cathode ray tube display as recited in claim 1, wherein the amplification means is physically located on the emission means.

10. A method for reducing the electric field emissions from a CRT display, the CRT being provided with a final anode voltage, the method comprising the steps of:

detecting the magnitude and phase of modulations in the final anode voltage and providing a first signal representing said modulations, the first signal not being directly dependent on a deflector and a device to drive the deflector of said display;

providing phase and gain correction to the first signal, said correction being dependent on the frequency of the signal;

amplifying the phase and gain corrected first signal such that a second signal of opposite polarity to that representing said modulations is produced; and radiating the second signal so as to create a cancelling electric field such that the field emissions from the CRT display are reduced.

* * * * *